US010542611B2

(12) United States Patent
Magielse et al.

(10) Patent No.: US 10,542,611 B2
(45) Date of Patent: Jan. 21, 2020

(54) LIGHTING CONTROL

(71) Applicant: SIGNIFY HOLDING B.V., Eindhoven (NL)

(72) Inventors: Remco Magielse, Tilburg (NL); Hugo Jose Krajnc, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/324,664

(22) PCT Filed: Jul. 27, 2017

(86) PCT No.: PCT/EP2017/069061
§ 371 (c)(1),
(2) Date: Feb. 11, 2019

(87) PCT Pub. No.: WO2018/029010
PCT Pub. Date: Feb. 15, 2018

(65) Prior Publication Data

US 2019/0174606 A1 Jun. 6, 2019

(30) Foreign Application Priority Data

Aug. 10, 2016 (EP) ..... 16183556

(51) Int. Cl.
*H05B 37/02* (2006.01)

(52) U.S. Cl.
CPC ..... *H05B 37/029* (2013.01); *H05B 37/0245* (2013.01)

(58) Field of Classification Search
CPC ..... H05B 37/0227; H05B 37/0272; H05B 37/029; H05B 37/0245; G06F 3/0482; G06F 3/04847
See application file for complete search history.

(56) References Cited

U.S. PATENT DOCUMENTS 5,463,286 A 10/1995 D'Aleo et al.
9,226,370 B2 12/2015 Berkvens et al.
(Continued)

FOREIGN PATENT DOCUMENTS

JP 2010205421 A 9/2010
WO WO-2010079388 A1 * 7/2010 ..... H05B 37/0245
WO 2015150927 A1 10/2015

*Primary Examiner* — Renan Luque
(74) *Attorney, Agent, or Firm* — Meenakshy Chakravorty

(57) ABSTRACT

According to one aspect disclosed herein, there is provided a method of controlling a lighting system comprising a first plurality of luminaires located in a first environment and a second plurality of luminaires located in a second environment, the method comprising steps of: receiving a first user input pattern at a light switch of the lighting system operatively coupled to the first plurality of luminaires; determining at least one parameter of a lighting scene being rendered by the first plurality of luminaires when the first user input pattern is received; storing an indication of the first user input pattern in association with the determined at least one parameter; receiving a second user input pattern at the or another light switch of the lighting system, operatively coupled to the second plurality of luminaires; comparing the received second user input pattern with the stored indication of the first user input pattern to determine if the second user input pattern matches the first user input pattern; if the second user input pattern is determined to match the first user input pattern, controlling the second plurality of luminaires to render a matching lighting scene using the at least one parameter.

14 Claims, 3 Drawing Sheets

(56) References Cited

U.S. PATENT DOCUMENTS

| | | | | |
|---|---|---|---|---|
| 9,295,144 | B2 | 3/2016 | Bora et al. | |
| 2010/0244746 | A1* | 9/2010 | Van De Sluis .... | H05B 37/0245 315/312 |
| 2015/0296594 | A1* | 10/2015 | Blum ..... | H05B 37/0227 315/158 |
| 2017/0295625 | A1* | 10/2017 | Lark, Jr. ..... | H05B 33/0845 |

* cited by examiner

LIGHTING CONTROL

CROSS-REFERENCE TO PRIOR APPLICATIONS

This application is the U.S. National Phase application under 35 U.S.C. § 371 of International Application No. PCT/EP2017/069061, filed on Jul. 27, 2017, which claims the benefit of European Patent Application No. 16183556.6, filed on Aug. 10, 2016. These applications are hereby incorporated by reference herein.

TECHNICAL FIELD

The present disclosure relates to systems and methods for controlling lighting devices to render a lighting scene in an environment.

BACKGROUND

WO2015/150927A1 discloses detecting a touch event at a touch interface of a luminaire. This touch event may be compared to a profile which is related to e.g. a light scene, according to which a luminaire may then be controlled.

Electronic devices are becoming ever more connected. A "connected" device refers to a device—such as a user terminal, or home or office appliance or the like—that is connected to one or more other such devices via a wireless or wired connection in order allow more possibilities for control of the device. For instance, the device in question is often connected to the one or more other devices as part of a wired or wireless network, such as a Wi-Fi, ZigBee or Bluetooth network. The connection may for example allow control of the device from one of the one or more other devices, e.g. from an app (application) running on a user device such as a smart phone, tablet or laptop; and/or may allow for sharing of sensor information or other data between the devices in order to provide more intelligent and/or distributed automated control.

In recent years, the number of connected devices has increased dramatically. Lighting systems are part of this movement towards a connected infrastructure. Conventional connected lighting systems consist of fixed light sources, which can be controlled through wall-mounted switches, dimmers or more advanced control panels that have pre-programmed settings and effects, or even from an app running on a user terminal such as a smart phone, tablet or laptop. For example, this may allow user to create an ambiance using a wide range of colored lighting, dimming options and/or dynamic effects. In terms of control the most common approach is to replace a light switch with a smart-phone based app that offers extended control over lighting (for example Philips hue, LIFX, etc.).

A lighting scene is a particular overall lighting effect in an environment rendered by the light sources in that environment. E.g. a "sunset" scene may be defined in which the light sources are set to output hues in the red-yellow range of the visible spectrum. Each light source may for example output the different hues (or other setting such as saturation or intensity), or a scene may be rendered by all (or some) lights rendering a single color or similar colors. Note that lighting scenes may be dynamic in that the output of one or more light source changes over time.

SUMMARY

Control devices for lighting systems range from simple traditional light switches having e.g. only buttons, knobs and/or sliders, to more advanced devices such as smart phones having a graphical user interface (GUI). In general, these advanced devices provide a greater degree of control of the luminaires. For example, existing apps allow a user to set a scene using colors of an image displayed on his user device. However, the present invention recognizes that a user of a lighting system may not always have an advanced control device available to him, or that there can be other circumstances in which using such a device is inconvenient.

The present invention allows the user to move lighting scenes from one environment to another environment without requiring an advanced control device, such as a smart-phone. That is, the user is provided with a degree of control over even complex lighting scenes using simple light switches having a basic user input mechanism—even a single button.

Hence, according to one aspect disclosed herein there is provided a method of controlling a lighting system comprising a first plurality of luminaires located in a first environment and a second plurality of luminaires located in a second environment, the method comprising steps of: a first user input pattern at a first light switch of the lighting system, the first light switch being operatively coupled to the first plurality of luminaires; determining at least one parameter of a lighting scene being rendered by the first plurality of luminaires when the first user input pattern is received; storing an indication of the first user input pattern in association with the determined at least one parameter; receiving a second user input pattern at a second light switch of the lighting system, the second light switch being operatively coupled to the second plurality of luminaires; comparing the received second user input pattern with the stored indication of the first user input pattern to determine if the second user input pattern matches the first user input pattern; if the second user input pattern is determined to match the first user input pattern, controlling the second plurality of luminaires to render a matching lighting scene using the at least one parameter. Alternatively, the two user input patterns may be received at the same switch, such as a portable switch.

The input pattern can, for example, be as simple as two or more presses of a button of the light switches in quick succession, though more complex patterns and/or switches can be used in other embodiments.

Connected lighting systems are able to render lighting scenes by receiving lighting instructions over the network (e.g. a ZigBee network) from, for example, a user device such as a smart phone, and interpret the lighting settings in order to determine the appropriate lighting settings for each light source in order that the lighting system renders a desired lighting scene in the environment.

The environment may be a user's house or home. In this case the lighting system may span several "sub-environments" such as the rooms of the house. The user of the lighting system may wish to implement a given scene in one room at one point in time and then the same scene in a different room at a later point in time. This behavior is generally called "follow me" behavior.

There are many descriptions and concepts available for automated "follow me" behavior for light settings. "Follow me" behavior implies that the user recalls light settings once, and wherever the user goes in his house, the light settings follow him. For example: the user has a scene based on his favorite holiday picture in the Living Room. When he moves to his Study room the light settings change to match the favorite holiday picture.

Current technologies for implementing "follow me" behaviors require a lot of sensing technologies and complex advanced computational algorithms. Furthermore, such systems can be susceptible to false positives (switching to a desired scene when the user does not want it) and false negatives (not switching to a scene as the user expected it to happen) which result in undesirable behavior.

The present invention relates to a simple way to provide the "follow me" behavior to users via manual interaction of the user. The manual interaction allows people to have a concept of 'copy-paste'—which is well known in desktop user interfaces—to replicate light settings from one location to the next.

One particular benefit of the present invention is that the user can in a very intuitive and flexible way re-deploy scenes as he moves around the house, without needing to re-configure the system via an app or without knowing whether that specific scene has been previously configured in the destination room or not.

According to one aspect disclosed herein, there is provided a method of controlling a lighting system comprising a first plurality of luminaires located in a first environment and a second plurality of luminaires located in a second environment, the method comprising steps of: receiving a first user input pattern at a light switch of the lighting system operatively coupled to the first plurality of luminaires; determining at least one parameter of a lighting scene being rendered by the first plurality of luminaires when the first user input pattern is received; storing an indication of the first user input pattern in association with the determined at least one parameter; receiving a second user input pattern at the or another light switch of the lighting system, operatively coupled to the second plurality of luminaires; comparing the received second user input pattern with the stored indication of the first user input pattern to determine if the second user input pattern matches the first user input pattern; if the second user input pattern is determined to match the first user input pattern, controlling the second plurality of luminaires to render a matching lighting scene using the at least one parameter.

In embodiments, the indication of the first input pattern stored in association with the determined at least one parameter is stored for a predetermined time and erased automatically after expiration of the predetermined time.

In embodiments, the indication of the first input pattern is stored in association with an identifier of a user who input the first input pattern; an identifier of a user who input the second user input pattern is compared with the stored indication of the first user input pattern to determine if the same user entered the first and second input patterns; and wherein the second plurality of luminaires are controlled to render the matching lighting scene on further condition that the same user is determined to have entered the first and second input patterns.

In embodiments, the first user input pattern is received at a first light switch and wherein the second user input pattern is received at a second light switch.

In embodiments, the first light switch is a fixed light switch mounted in the first environment, and the second light switch is a fixed light switch mounted in the second environment.

In embodiments, the user input patterns are received at the same light switch which is a portable light switch.

In embodiments, the method further comprises a step of controlling the first plurality of luminaires to turn off in response to receiving the first user input pattern.

In embodiments, the method further comprises a step of if the second user input pattern is not determined to match the first user input pattern, providing an indication to the user that the second user input pattern did not match the first user input pattern.

In embodiments, said indication is provided to the user via the second plurality of luminaires.

In embodiments, said indication is provided to the user via a user device.

In embodiments, said user input pattern comprises at least a first tap and a second tap of a button of the light switch.

In embodiments, said steps of determining and storing are performed conditionally in response to the second tap being received within a predetermined time of the first tap.

In embodiments, the method further comprises determining a first duration being a duration of the first tap and a second duration being a duration of the second tap, and wherein the said user input pattern comprises a pattern of at least the first duration and the second duration.

According to another aspect disclosed herein, there is provided a computer program product comprising code stored on a computer-readable storage medium and configured so as when executed to implement the method of any of the embodiments disclosed herein.

According to another aspect disclosed herein, there is provided a lighting system comprising a first plurality of luminaires located in a first environment and a second plurality of luminaires located in a second environment, one or more light switches configured to receive user input patterns, and a controller configured to perform steps of: detecting a first user input pattern received at one of the light switches which is operatively coupled to the first plurality of luminaires; determining at least one parameter of a lighting scene being rendered by the first plurality of luminaires when the first user input pattern is received; storing an indication of the first user input pattern in association with the determined at least one parameter; detecting a second user input pattern received at the or another of the light switches which is operatively coupled to the second plurality of luminaires; comparing the received second user input pattern with the stored indication of the first user input pattern to determine if the second user input pattern matches the first user input pattern; if the second user input pattern is determined to match the first user input pattern, controlling the second plurality of luminaires to render a matching lighting scene using the at least one parameter.

BRIEF DESCRIPTION OF THE DRAWINGS

To assist understanding of the present disclosure and to show how embodiments may be put into effect, reference is made by way of example to the accompanying drawings in which.

DETAILED DESCRIPTION OF EMBODIMENTS

Figure 1:
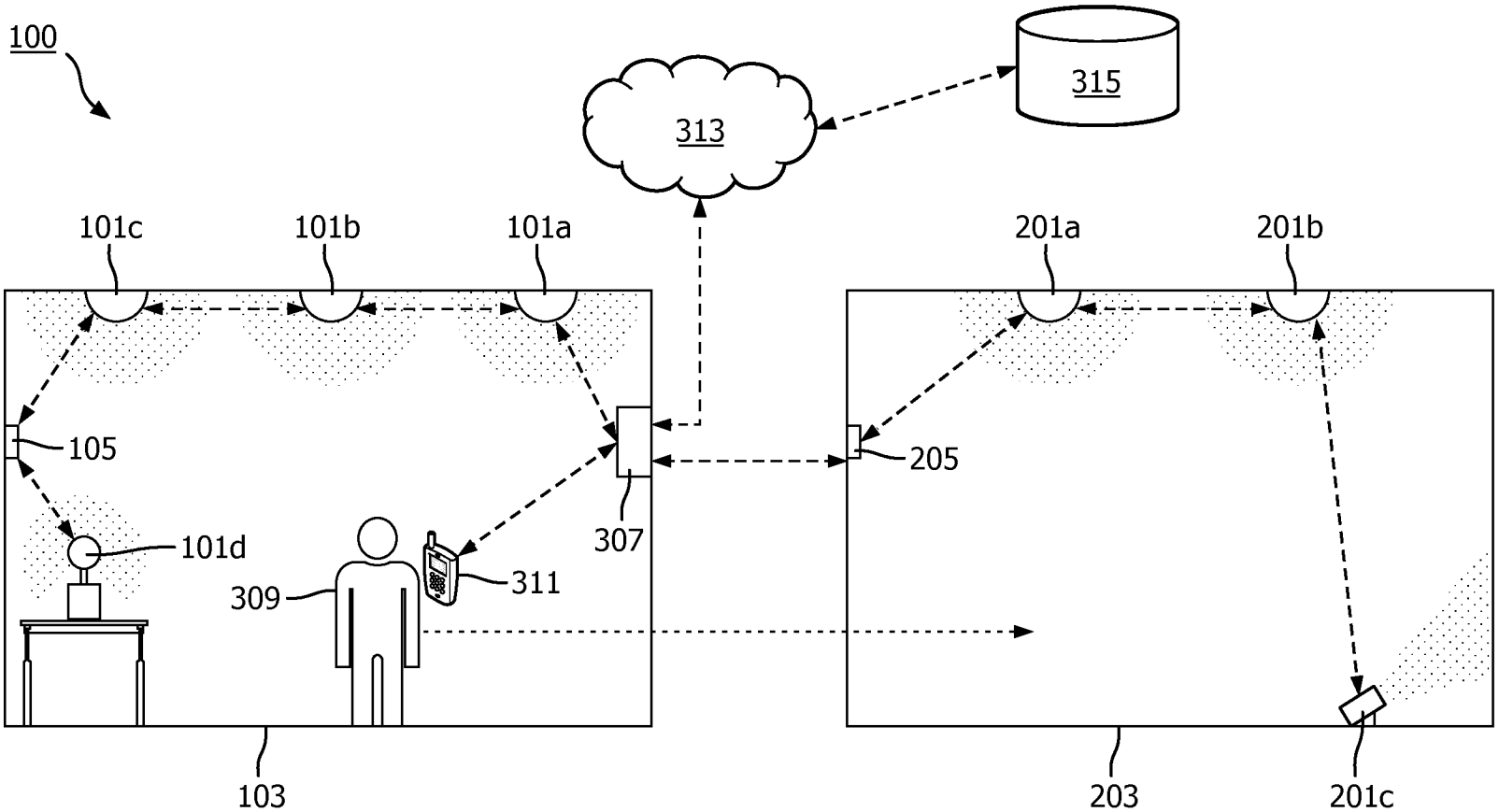
FIG. 1 shows a system according to embodiments of the present invention.

The present invention relates to a user-triggered mechanism to move scenes from one location to another. Users can 'encode' a pattern in one room and recall those light settings using the pattern in another room. Switches can then be used to 'copy-paste' light settings between rooms in the lighting system.

The basic premise of this invention is that a user can assign a coding pattern (also called an input pattern) to light settings in one room. If the user then uses that coding pattern in another room, the lighting system will apply the light settings of the previous room as good as possible.

For example, a user may have set up the luminaires in one room (e.g. the living room) of his house to be rendering a "sunset" scene, but wishes to move to another room (e.g. the bedroom) where he would like the sunset scene to be rendered.

In some prior art systems the user would have move to the bedroom (and optionally turn off the luminaires in the living room), and then re-deploy the sunset scene (e.g. by taking his smart phone out and selecting the sunset scene and instructing the system to render the scene in the bedroom. This may be tedious for the user as it requires in-depth manual re-deployment of the sunset scene once he reaches the bedroom. This redeployment may be cumbersome for the user as it requires extra steps such as selecting the same source image for the scene, individually configuring each luminaire to the sunset colors, or saving the scene etc.

In other prior art systems, "follow me" behavior can be implemented by tracking the user's location and deploying the sunset scene dynamically into the user's current room as he moves from the living room to the bedroom. However, the position tracking requires an extensive system of sensors which may be expensive.

In the present invention, the user can simply input a pattern into the system which is then assigned to the sunset scene within the system, and use this same pattern to redeploy the sunset scene in the bedroom. For example, the user might triple-tap on a switch in the living room which causes the system to associate the triple-tap with the sunset scene. The triple-tap might also turn off the luminaires in the living room, but this is optional. For example, a different pattern such as single tap may be used as an off command, and a triple tap may be used as a "copy" command and wherein the system ignores the "off" functionality. In any case, when the user later enters the bedroom, a triple-tap of the bedroom switch is all that is need to instruct the system to render the sunset scene in the bedroom.

Preferably, the user 309 needs to start a pattern on a single button of a light switch within a specified time interval (e.g., 1 second) for the switch to detect the button events as a pattern. So the first two presses have to happen within the time interval. After that, the user can encode any pattern into the system. There is a timeout of, e.g. 3 seconds: If the user does not press the button 3 seconds after the last press, the pattern is concluded.

FIG. 1 shows a system 100 according to embodiments of the present invention. A first environment 103 contains a first plurality of luminaires 101*a-d* and a first switch 105. Luminaires 101*a-c* are ceiling type luminaires designed to provide illumination in the first environment 103 from above Luminaire 101*d* is a free-standing lamp type luminaire placed on a table designed to provide illumination in the first environment 103 from a lower position than the ceiling type luminaires 101*a-c*. Each of the luminaires 101*a-d* may be any suitable type of luminaire such as an incandescent light, a fluorescent light, an LED lighting device etc. The plurality of luminaires 101*a-d* may comprise more than one type of luminaire, or each luminaire 101*a-d* may be of the same type.

The first switch 105 is shown in FIG. 1 as a wall-mounted switch and may be any suitable type of switch allowing user input to control the first plurality of luminaires 101*a-d*. For example, the first switch 105 may be a simple on-off controller switch or may allow for more complex control such as dimming and possibly even control of individual lighting characteristics such as hue and saturation. The first switch 105 is part of the lighting system in that the first switch 105 is able to send data to and receive data from the other elements in the lighting system. Particularly, the first switch 105 is able to access a shared memory of the lighting system (e.g. memory 315, described later).

Similarly, a second environment 203 contains a second plurality of luminaires 201*a-c* and a second switch 205 Luminaires 201*a-b* are ceiling type luminaires designed to provide illumination in the second environment 203 from above. Luminaire 201*c* is wall-washer type luminaire placed on the floor of the second environment 203 and arranged to provide illumination in the second environment 203 by illuminating a wall of the second environment 203. Again, each of the luminaires 201*a-s* may be any suitable type of luminaire such as an incandescent light, a fluorescent light, an LED lighting device etc. The second plurality of luminaires 201*a-c* may comprise more than one type of luminaire, or each luminaire 201*a-c* may be of the same type.

The second switch 205 is shown in FIG. 1 as a wall-mounted switch and may be any suitable type of switch allowing user input to control the first plurality of luminaires 201*a-d*. For example, the second switch 205 may be a simple on-off controller switch or may allow for more complex control such as dimming and possibly even control of individual lighting characteristics such as hue and saturation. The second switch 205 is part of the lighting system in that the second switch 205 is able to send data to and receive data from the other elements in the lighting system. Particularly, the second switch 205 is able to access a shared memory of the lighting system (e.g. memory 315, described later).

The first plurality of luminaires 101*a-d*, the first switch 105, the second plurality of luminaires 201*a-c* and the second switch 205 along with a lighting bridge 307 form a connected lighting network. That is, they are all interconnected by wired and/or wireless connections, indicated by dotted lines in FIG. 1. In particular, FIG. 1 shows "chaining" connections such as may be implemented in a ZigBee lighting network, wherein it is not necessary for each device to be directly connected to each other device. Instead, devices are able to relay communication signals which allows for, for example, luminaire 101*c* to communicate with the lighting bridge 307 by relaying data through luminaires 101*b* and 101*c* to lighting bridge 307. However, it is not excluded that other network topologies may be employed. For example, a "hub-and-spoke" topology may be used in which each device is directly connected (e.g. wirelessly) to the lighting bridge 307 and not to any other devices in the network.

As another example, each luminaire in the network may be configured according to one communication protocol, such as ZigBee, and the switches may be configured according to another communication protocol, such as WiFi. Hence, it is appreciated that the luminaires may communicate with each other and the lighting bridge 307 without relaying data through a switch as shown in FIG. 1, and the switches 105, 205 may communicate directly with the lighting bridge 307. In any case, it is understood that the lighting bridge 307 is able to communicate, by whatever appropriate means, with each other device in the lighting network.

Lighting bridge 307 is arranged at least to receive input (e.g. from switches 105, 205) and to send lighting control commands to luminaires 101*a-d*, 201*a-c*.

FIG. 1 also shows a user 309 and user device 311 such as a smart phone. The user device 311 is operatively coupled to the lighting bridge 307 by a wired or wireless connection (e.g. WiFi or ZigBee) and hence forms part of the lighting network. User 209 can provide user input to the lighting bridge 307 via the user device 311 using, for example, a graphical user interface of the user device 311. The lighting bridge 307 then interprets the user input and sends control commands to the luminaires 101*a-d*, 201*a-c* accordingly. As mentioned above, the user device 311 generally allows for more complex control than the switches 105, 205. For example, the user 309 may use the user device 311 to control an individual luminaire. In general it is desirable for each switch to control the luminaires in the same environment as the switch itself, i.e. in FIG. 1 switch 105 controls only luminaires 101*a-d* and switch 205 controls only luminaires 201*a-c*, but the user device 311 may control any luminaire at all within the lighting network. For example, the user 309 may use the user device 311 to control a luminaire in another environment, such as controlling a luminaire in a different room other than the room in which the user 309 and user device 311 are currently. This is particularly advantageous because the user device 311 is generally more portable than a switch (particularly a wall-mounted switch), and hence may be used at different physical locations. The user device 311 may be used to control the first and/or second plurality of luminaires to render a lighting scene, e.g. by the user 309 selecting the lighting scene and desired luminaires using a GUI of the user device 311.

As illustrated in FIG. 1, lighting bridge 307 may also be provided with a wide area network (WAN) connection such as a connection to the internet 313. This connection, as known in the art, allows the lighting bridge 307 to connect to external data and services such as memory 315. Note that the wireless connection between user device 311 and the lighting bridge 307 is shown in FIG. 1 as a direct connection, but it is understood that the user device 311 may also connect to the lighting bridge 307 via the internet 313.

In operation, the first plurality of luminaires 101*a-d* are rendering a lighting scene. User 309 may have controlled the luminaires 101*a-d* via the lighting bridge 307 using his user device 301 (or by switch 105) to render the lighting scene, or the lighting scene may have been automatically triggered by, for example, detection of the presence of user 309 by a presence sensor (not shown), by a timer, or by an external event or trigger e.g. from a cloud-based server from other services such as a trigger based on local meteorological data. The second plurality of luminaires 201*a-c* may or may not also be rendering a (possibly different) lighting scene.

In the present invention, the user 309 is able to 'copy-paste' (or 'cut-paste') the lighting scene from the first environment 103 to the second environment 203. To achieve this, the user 309 provides a first user input pattern to a controller of the lighting system which then stores the first user input pattern in association with the lighting scene. When the user 309 later provides a second user input pattern which matches the first user input pattern, the controller recalls the lighting scene from memory and controls the second plurality of luminaires 201*a-c* to render the lighting scene in the second environment.

The lighting scene may initially be set using the user device 311 (for example), but this copy-and-paste functionality of the lighting scene once set is implemented using the light switches 105, 205 alone.

Figure 2:
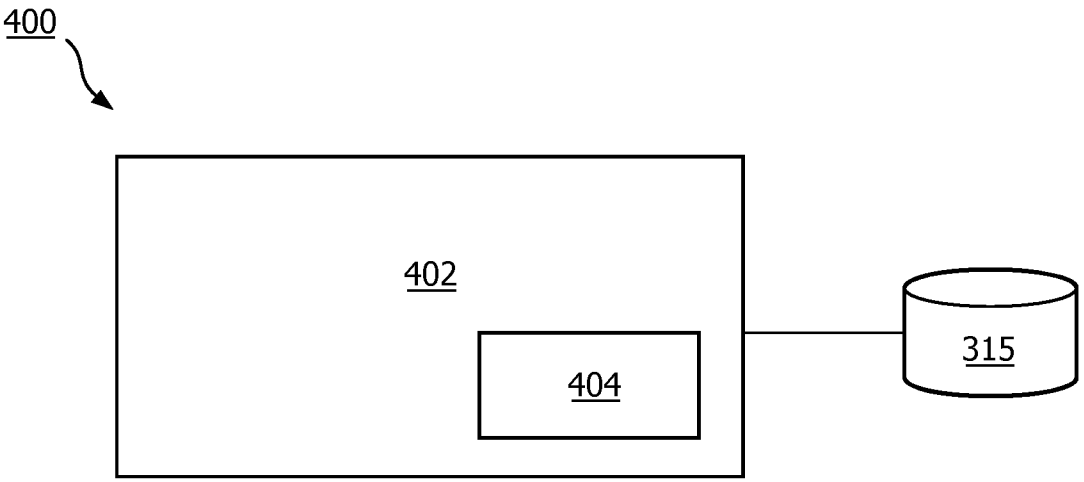
FIG. 2 is a functional block diagram of a controller according to embodiments of the present invention.

FIG. 2 shows a functional block diagram of a controller 400. The controller 400 is a functional block providing the functionality described herein, and the controller 400 may be implemented solely in hardware, software, or in a combination of hardware and software. Hence, it is understood that FIG. 2 is for the purposes of illustration only. FIG. 2 shows the controller 400 as comprising code 404 running on at least one processor 402. That is, it is understood that the controller 400 shown in FIG. 2 represent a functional block which is implemented in the lighting system 100 shown in FIG. 1. For example, the controller 400 may be implemented in the lighting bridge 307, one of the first plurality of luminaires 101*a-d*, one of the second plurality of luminaires 201*a-c*, the first switch 105, the second switch 205, or the user device 311. It is also understood that the controller 400 may be implemented in a distributed manner with some functionality being implemented in one entity of the lighting system (as mentioned above) and other functionality implemented in one or more other entities of the lighting system.

Figure 3:
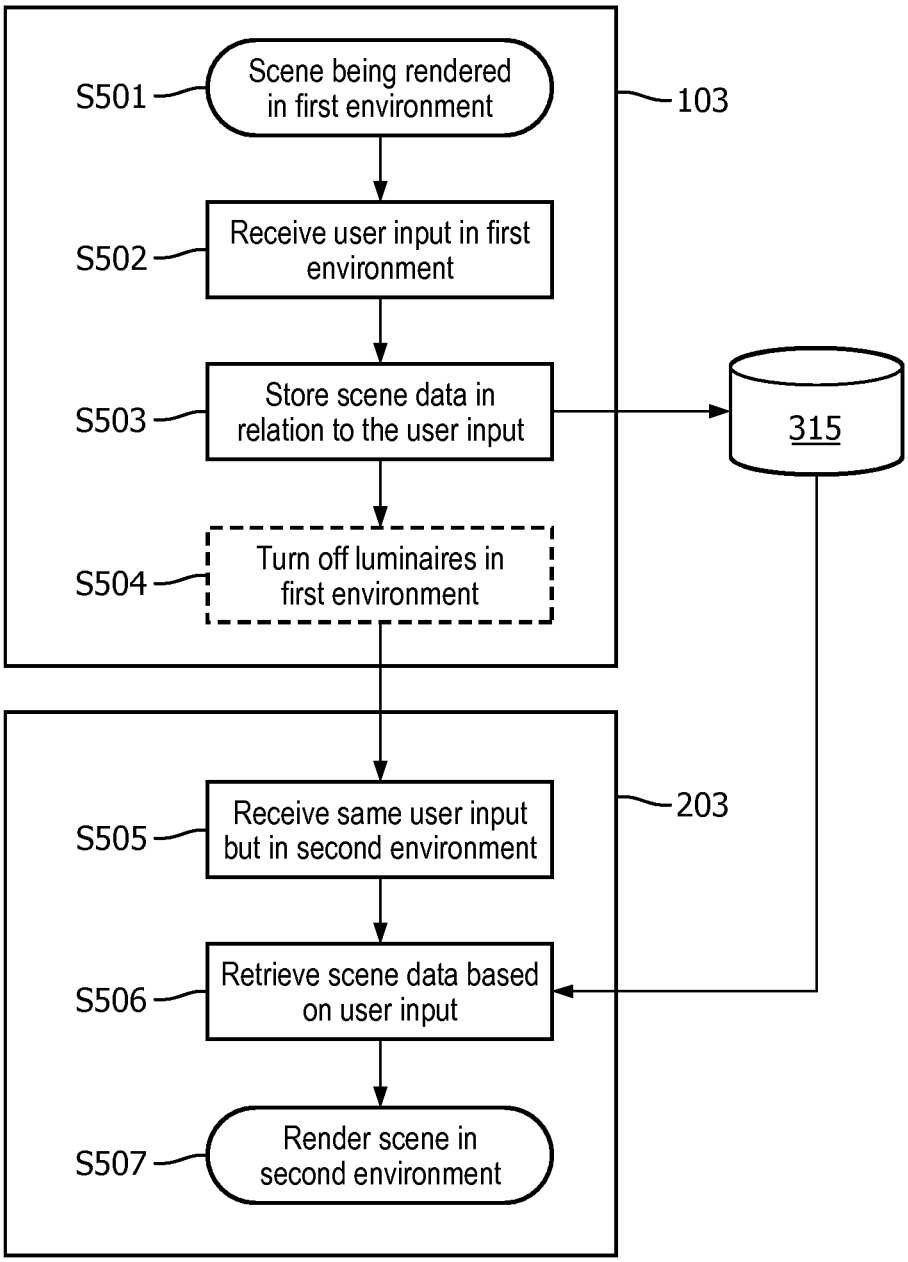
FIG. 3 is a method performed by the controller in accordance with embodiments of the present invention.

FIG. 3 is a flow diagram of a method implemented by the controller 400 in accordance with embodiments of the present invention. For the purposes of understanding only, FIG. 3 shows steps S501-504 as being performed in association with the first environment 103 and steps S505-507 as being performed in association with the second environment 203.

The method begins at step S501 with a scene being rendered in the first environment 103. At step S502, user input is received at the controller 400 from either the first switch 105. The controller 400 is able to determine that the input is in association with the first environment 103, as the controller 400 has been commissioned to know that the first switch 105 is located within, or controls the luminaires of the first environment 103.

The controller 400 then proceeds, in step S503, to store the scene data as associated with the user input pattern. FIG. 3 shows the scene data being stored in memory 315 but it is appreciated that this data could be stored in any location or storage means provided that the controller 400 is able to access the stored data at a later time. In this sense, the memory 315 may be a local memory to the controller 400 residing in one or more of the same physical units, or may be an external memory such as an external server accessible over the internet 313.

The controller 400 may then optionally, as shown in step S504, turn off the first plurality of luminaires. If S504 is included, the method may be considered a 'cut-and-paste' method, in the sense that the scene is removed from the first environment 103 (before being deployed in the second environment 203). If S504 is omitted, the method may be considered a 'copy-and-paste' method, in the sense that the scene remains in the first environment 103 despite being 'copied' to the second environment 203. To continue the analogy from known 'copy-and-paste' methods employed in computing systems, the step S503 of storing the scene to memory 315 is analogous to a computer (usually temporarily) storing a copied item to the 'clipboard' for later use.

At step S505, the user 309 has moved into the second environment 203 and inputted a second input pattern into the system. This input may be performed in a similar manner to that described above in relation to step S502, i.e. using a switch.

At step S506 the controller 400 determines whether or not there is a scene stored in association with the user input received at step S505. That is, the controller 400 determines whether there is a matching user input stored in memory 315 and, if there is, retrieves the scene data stored in association with that user input pattern from memory 315.

In a similar manner to that described above in relation to step S502, the controller 400 is able to determine that the second user input (at step S505) is in association with the second environment 203. Hence, the controller 400 is able to determine appropriate luminaires (i.e. the second plurality of luminaires 201*a-c*) using, e.g. a commissioning data such as the map defining zones mentioned above. The method then proceeds to step S507 wherein the controller 400 controls the second plurality of luminaires 201*a-c* to render the lighting scene.

Note that if the controller 400 determines that there is no stored user input pattern which matches the input pattern received at step S505, there are several options available. This depends on whether the controller 400 is able to distinguish between an input pattern being a first input pattern intended to "copy" a scene, or a second input pattern intended to "paste" a scene. These are discussed in turn below. The controller 400 may be able to distinguish these based on current lighting settings in the environment in which the input pattern is received. For example, if the input pattern is received at step S505 in the second environment whilst the luminaires in the second environment are in the "off" state, the controller 400 may determine that the input pattern was intended as a "paste" command. If the controller 400 is able to distinguish, there are a few options available. As a first example, the controller 400 may do nothing (i.e. not control any of the luminaires in the system to change their settings), and may wait for a further input to be received, in which case the controller 400 may re-preform step S505 and proceed as described above if the further input matches a stored pattern.

As a second example, the controller 400 may control one or more luminaires in the system (e.g. preferably the second plurality of luminaires 201*a-c* which are visible by the user 209) to signal to the user 309 that the input pattern was not recognized. This may be done by flashing the one or more luminaires, or changing their color.

As a third example, the controller 400 may be operatively coupled to another device such as a loudspeaker. In which case, the controller 400 may signal to the user 309 that the input pattern was not recognized by controlling the loudspeaker to emit sound. Other examples are readily apparent to one skilled in the art, such as signaling to the user 309 using a display or through his user device 311 using a visible, audible, or tactile signal, or combination thereof.

The above examples may be used in combination. For example, the controller 400 may signal to the user 309 using the luminaires and then wait for a further input to be received, in which case the controller 400 may re-preform step S505 and proceed as described above if the further input matches a stored pattern.

If the controller 400 is not able to distinguish whether what the user just tapped is a "paste" command that is not recognized, or a new coding pattern waiting to be used in a further room, a second timing parameter may be used by the controller 400 as a "lifetime" of a pattern, i.e. a timeout for the pattern to cease to exist (as opposed to the first timing parameter discussed above which is to determine the pattern).

In this case, every time a pattern is entered by the user, it is recorded in memory for a set amount of time, e.g. 5 seconds, 10 second etc. After this time, the pattern is erased from memory meaning that no scene is associated to that pattern. Therefore, there are the following possible scenarios:

1. A user encodes a triple tap pattern, and within 5 seconds the user presses a triple tap pattern in a different room. The scene copy-pasted as normal.
2. A user encodes a triple tap pattern, and within 5 second the user presses a double tap pattern in a different room, and the double tap pattern has not been encoded within the last 5 seconds. At least one of the first, second, or third examples described above will be carried out, e.g. the user is provided feedback that the double tap pattern is an unknown pattern.
3. A user encodes a triple tap pattern, and within 5 seconds the user presses a double tap pattern in a different room, and that double pattern had also been encoded within the same 5 seconds. The scene linked to the double tap pattern is then deployed.
4. A user encodes a triple tap pattern, and after more than 5 seconds the user presses a triple tap pattern in a different room. The triple tap pattern by this point has been erased from memory and therefore the new entry of the triple tap pattern in the different room is used as to "copy" the scene in that room. That is, the new use of the triple pattern overrides the previous one. Optionally, the system may give feedback to the user (e.g. via user device) saying that the pattern used was overwritten/was not empty, etc.

The following is an example of a scenario for the purposes of understanding only. In this scenario, a user is in the living room reading and listening to music. A beach scene consisting of red, orange and yellow light colors is deployed in the living room:

After reading for some time in the living room, the user decides to take a bath and to continue reading.

The user leaves the living room and presses the off switch twice, and in this way encoded a double tap with the 'beach scene'. The user 'copies' the light settings into the system, encoded by a double tap.

Upon entering the bathroom, the user double taps the on switch twice.

The system detects that this is another room and that recently double tap has been associated to the 'beach scene'. It extracts the colors from that scene and intelligently applies that to the bathroom. The scene is 'pasted' into the bathroom.

For the user, the lights turn on to the beach scene: the scene followed the user to the bathroom.

So far, the only user input pattern described has been either a double-tap or a triple-tap of a button. However, any other pattern may be used provided that the controller 400 is able to distinguish between them.

When the first and second switches comprise only a button for use by the user 309, preferably the button is be capable of detecting the time between button presses and (possibly) the duration of button presses. This allows the switches to distinguish between short and long taps in a manner analogous to Morse Code. A switch may comprise more than one button, in which case the pattern may be a plurality of taps which combined taps of each button in a manner analogous to a keypad door lock.

Preferably, the switches are configured to only consider a received pattern if the second tap is input within a predetermined time of the first tap (e.g. 5 seconds). The system then detects the encoded signal by composing all the button events received in time after each other.

This means that if a user presses shortly twice, the system records this as two taps (* *). If the user presses shortly three times, the system records this as three taps (* * *). If the user presses once, and then no further presses are recorded by the switch within the predetermined time, the system may record only the single tap (*) which may be used to turn the luminaires on/off. This is particularly advantageous as the system maintains traditional light switch behavior wherein the light switch toggles the on state of the luminaires. The advanced pattern behavior of the present invention is then still accessible to the user 309 by tapping multiple times within the predetermined time.

The switches may also be able to determine the duration of a press of a button. This allows users to use short and long presses in the input pattern, so the user can create a truly custom pattern (* * - *) or (* - - -).

Each pattern can also be associated to different users in the same home, where each has a specific coding that can apply to store and recall scenes in the same rooms without accidentally recalling that of a different user. The controller 400 may determine which user has input the pattern by, for example, determining which user's user device is closest to the switch at which the input pattern was received. As is known in the art, the location of the user device 311 may be determined e.g. using GPS or a plurality of location beacons combined with ToF, RSSI and triangulation, trilateration, multilateration etc. methods. This location may be provided to the controller 40 allowing it to determine that the user device is within a predetermined distance of a given switch. For example, consider the scenario in which there are two users: user A with user device A and user B with user device B. When an input pattern is received at the first switch 105, the controller 400 can use the locations of user devices A and B to determine which user was most likely to have entered the input pattern. For example, if user device A was one meter away from the first switch 105 at the time the pattern was input, and user device B was twenty meters away, the controller 400 determines that user A input the pattern at the first switch 105. The controller 400 may then store an indication of the pattern along with a lighting scene parameter in association with user A. This is particularly advantageous as it allows users A and B to have a sense of a personal clipboard for storing lighting scenes. In this scenario, for example, at a later time when a matching second input pattern is received at the second switch 205 the controller 400 would only control the second plurality of luminaires 201*a-c* to render the scene in the second environment if user A entered the matching second pattern (and not user B). Which user entered the second pattern can be determined in a manner similar to described above.

It will be appreciated that the above embodiments have been described only by way of example. Other variations to the disclosed embodiments can be understood and effected by those skilled in the art in practicing the claimed invention, from a study of the drawings, the disclosure, and the appended claims.

For example, the system may always store the latest encoded scene into the system. This also allows user to override previous settings.

Optionally, the time in which a light scene can be moved to another room can be limited to avoid confusion. For example: after an hour the stored scene is lost and cannot be recalled. Additionally, this may be also limited to specific periods e.g. disabled at night to avoid accidentally waking up someone else.

Optionally, instead of a one-time copy, it is also possible to assign the 'copy' and 'paste' behavior to different buttons of a switch:

- The user can store scenes into the system by encoding a pattern using the 'off' button of a switch.
- The user can recall scenes into the system by encoding a pattern using the 'on' button of a switch.
- The system can store multiple scenes at a time as long as they are encoded with different patterns.

Optionally, the coding patterns need not be fixed over time or per user, as long as the same pattern is used to both store and recall the scene. This means that the mechanism becomes even more flexible as it is not necessary for the user to remember always a specific coding scheme, but just for the transition between rooms.

Optionally, a condition can be applied to the system that encoded scenes can only be recalled in other rooms than the one in which they were stored. That means that encoded scenes always have to transfer to another room.

Optionally, the detection of a specific recall sequence can take into account the tap encoding, the button used for the encoding, or any combination of these (e.g. double tapping on any button is always the same, or triple tapping must always be done in the same button as used when storing, etc.)

Optionally, in systems where the devices can detect each other's presence by e.g. beaconing mechanisms, it would also be possible that the user both stores and recalls the scenes using the same input device, where the system can detect via the beaconing mechanism that this device changed room and the coding now applies to the lighting devices in the destination room.

Note that the control devices (i.e. the switches) do not need to be "wall-mounted"; in fact, they can be portable devices as well. The only functionalities they require is that:

- They are "connected", i.e. they can control the luminaires via the wireless network.
- They are assigned to the specific set of lights present in that same room. For a portable switch this can be achieved by measuring the location of the switch and determining which environment the switch is in order to adapt the luminaires which the switch controls. I.e. the switch controls whichever luminaires are present in the same environment as it, at any given time.

Also, it is not necessary that there are two or more control devices involved. That is, it is also possible to have a single remote control that is contextually aware (i.e. knows in which room it is in). In this case, the user can encode a pattern in the first environment (as the remote control knows it is in the first environment, so the scene from the first environment can be identified as the scene to be copied), and then move to the second environment and use the same remote control to "paste" the scene by entering the pattern again on the remote control.

In other words, a portable light switch may be used. In this case the portable light switch may be operatively coupled to different sets of luminaires depending on its location. I.e. the operative coupling to luminaires described above can change automatically in response to change in the location of the portable light switch. This may be achieved for example by the portable light switch controlling only luminaires within a given physical radius of itself, or only luminaires within a given communicable range (e.g. a signal range such as line-of-sight).

Further, it is appreciated that the above has been described with reference to a central controller 400. However, the present invention can be implemented in systems where there is no central device aggregating the data (i.e. controller 400). In these cases, all devices are able to communicate with each other (in different protocols if necessary), such that e.g. when a first pattern is detected in the first control device, it relays that pattern and associated scene to all other relevant devices, such that when the same pattern is detected in a second control device it is not necessary to consult or retrieve information from a central controller.

In the claims, the word "comprising" does not exclude other elements or steps, and the indefinite article "a" or "an" does not exclude a plurality. A single processor or other unit may fulfil the functions of several items recited in the claims. The mere fact that certain measures are recited in mutually different dependent claims does not indicate that a combination of these measures cannot be used to advantage. A computer program may be stored and/or distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

The invention claimed is:

1. A method of controlling a lighting system comprising a first plurality of luminaires located in a first environment and a second plurality of luminaires located in a second environment, the method comprising steps of:

receiving a first user input pattern at a first light switch of the lighting system operatively coupled to the first plurality of luminaires;

determining at least one parameter of a lighting scene, being rendered by the first plurality of luminaires, when the first user input pattern is received;

storing an indication of the first user input pattern in association with the determined at least one parameter;

receiving a second user input pattern at a second light switch of the lighting system, operatively coupled to the second plurality of luminaires;

comparing the received second user input pattern with the stored indication of the first user input pattern to determine if the second user input pattern matches the first user input pattern;

if the second user input pattern is determined to match the first user input pattern, controlling the second plurality of luminaires to render a matching lighting scene using the at least one parameter.

2. The method according to claim 1, wherein the first light switch is a fixed light switch mounted in the first environment, and the second light switch is a fixed light switch mounted in the second environment.

3. The method according to claim 1, wherein the indication of the first input pattern stored in association with the determined at least one parameter is stored for a predetermined time and erased automatically after expiration of the predetermined time.

4. The method according to claim 1, wherein the indication of the first input pattern is stored in association with an identifier of a user who input the first input pattern; an identifier of a user who input the second user input pattern is compared with the stored indication of the first user input pattern to determine if the same user entered the first and second input patterns; and wherein the second plurality of luminaires are controlled to render the matching lighting scene on further condition that the same user is determined to have entered the first and second input patterns.

5. The method according to claim 1, further comprising a step of controlling the first plurality of luminaires to turn off in response to receiving the first user input pattern.

6. The method according to claim 1, further comprising a step of if the second user input pattern is not determined to match the first user input pattern, providing an indication to the user that the second user input pattern did not match the first user input pattern.

7. The method according to claim 6, wherein said indication is provided to the user via the second plurality of luminaires.

8. The method according to claim 6, wherein said indication is provided to the user via a user device.

9. The method according to claim 1, wherein said user input pattern comprises at least a first tap and a second tap of a button of the light switch.

10. The method according to claim 9, wherein said steps of determining and storing are performed conditionally in response to the second tap being received within a predetermined time of the first tap.

11. The method according to claim 9, further comprising determining a first duration being a duration of the first tap and a second duration being a duration of the second tap, and wherein the said user input pattern comprises a pattern of at least the first duration and the second duration.

12. A non-transitory computer readable medium comprising code configured so as when executed on one or more processors, implements the method of claim 1.

13. A lighting system comprising a first plurality of luminaires located in a first environment and a second plurality of luminaires located in a second environment, one or more light switches configured to receive user input patterns, and a controller, wherein the controller is arranged for:

detecting a first user input pattern received at a first light switch which is operatively coupled to the first plurality of luminaires;

determining at least one parameter of a lighting scene, being rendered by the first plurality of luminaires, when the first user input pattern is received;

storing an indication of the first user input pattern in association with the determined at least one parameter;

detecting a second user input pattern received at a second light switch which is operatively coupled to the second plurality of luminaires;

comparing the received second user input pattern with the stored indication of the first user input pattern to determine if the second user input pattern matches the first user input pattern;

if the second user input pattern is determined to match the first user input pattern, controlling the second plurality of luminaires to render a matching lighting scene using the at least one parameter.

14. The lighting system according to claim 13, wherein the first light switch is a fixed light switch mounted in the first environment, and the second light switch is a fixed light switch mounted in the second environment.

* * * * *